United States Patent [19]

Seelen

[11] Patent Number: 4,531,725

[45] Date of Patent: Jul. 30, 1985

[54] SHEET INVERTER

[75] Inventor: Franciscus J. H. M. Seelen, Venlo, Netherlands

[73] Assignee: Océ-Nederland B.V., Venlo, Netherlands

[21] Appl. No.: 496,303

[22] Filed: May 19, 1983

[30] Foreign Application Priority Data

Jun. 14, 1982 [NL] Netherlands ..... 8202399

[51] Int. Cl.[3] ..... B65H 29/00

[52] U.S. Cl. ..... 271/186; 271/188; 271/902

[58] Field of Search ..... 271/DIG. 9, 184, 185, 271/186, 245, 65

[56] References Cited

U.S. PATENT DOCUMENTS

| | | | |
|---|---|---|---|
| 3,337,213 | 8/1967 | La Barre | 271/184 X |
| 4,262,895 | 4/1981 | Wenthe | 271/65 |
| 4,453,819 | 6/1984 | Wada et al. | 271/DIG. 9 X |

FOREIGN PATENT DOCUMENTS

| | | | |
|---|---|---|---|
| 7400759 | 7/1975 | Netherlands | 43/12 |

OTHER PUBLICATIONS

Bach, P. S., "Sheet Inverter", IBM Technical Disclosure Bulletin, vol. 18, No. 3, Aug. 1975, pp. 628–629.

Xerox Disclosure Journal, vol. 6, No. 4 (Jul./Aug. 1981) pp. 179–180.

*Primary Examiner*—George E. A. Halvosa
*Assistant Examiner*—Lawrence J. Goffney, Jr.
*Attorney, Agent, or Firm*—Albert C. Johnston

[57] ABSTRACT

An inverter for reversing the direction of movement of sheets fed to it even at high speed comprises a guide member onto and along which a sheet is fed and having an end edge portion spaced a small distance from a bend-over guide that lies across and at an acute angle to the path of the leading edge of the sheet and deflects the leading edge so that a leading portion of the sheet is bent over the end edge portion to retard the sheet movement. The sheet then is in a position to be delivered by movement in the reverse direction. The bend-over guide typically is disposed at a distance of 3 to 10 mm from the end edge portion and at an acute angle of 60° to 85° to the adjacent surface of the guide member. Preferably, the guide member presents a concavely bowed sheet guiding surface having angled recesses extending across it.

11 Claims, 1 Drawing Figure

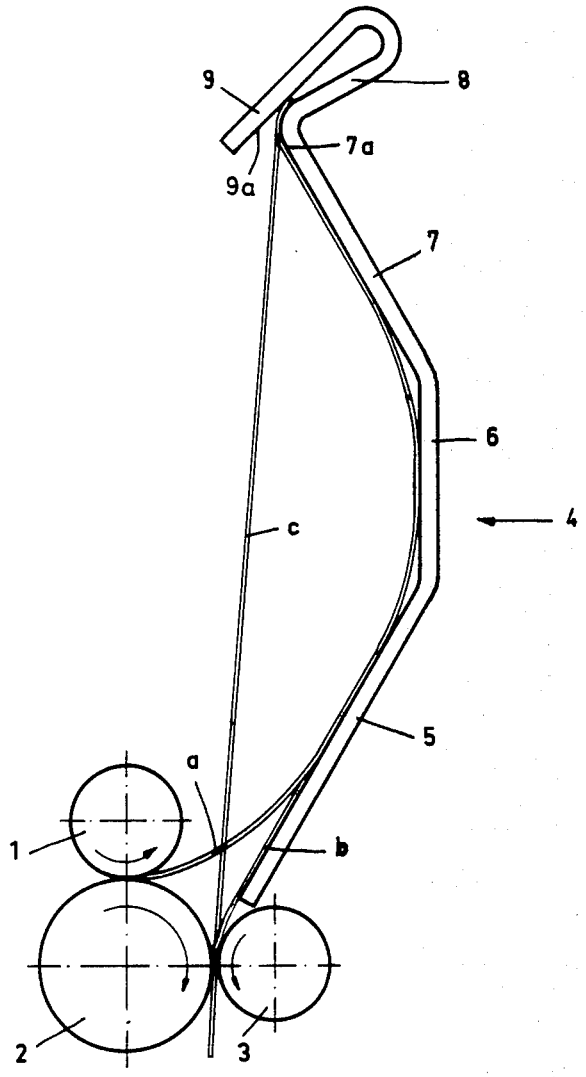
9
8
7a
9a
7
6
4
c
5
a
1
b
2
3

SHEET INVERTER

This invention relates to a sheet inverter for reversing the direction of movement of sheets.

Such sheet inverters are used in a variety of processes. An important use of them, for example, is in combination with collators in which sheets delivered by printing or copying machines are collated in the proper order.

U.S. Pat. No. 4,228,995 discloses a collator in which the movement of sheets is reversed by feeding each sheet onto and then backward from an upwardly inclined guide. A disadvantage of the device is that the sheets fed can move uncontrolledly over the guide so that there is risk of skewing and hence a risk of disturbances during the delivery and subsequent disposition of the sheets. This risk increases with increases of the speed of movement of the sheets.

It has been proposed in U.S. Pat. No. 4,262,895 to restrict the freedom of movement of sheets in an inverter guide by the provision of an abutment against which the leading edge of a sheet abuts when the sheet is passed over the guide. A provision of that kind may be of advantage when the speed of advance of the sheet is low, but it is disadvantageous when a sheet is fed at high speed, for example at 40 cm/sec or more, because a sheet so fed rebounds uncontrollably from the abutment due to its resiliency.

A "Xerox Disclosure Journal" of July/August 1981, pages 179–180, discloses a device for inverting sheets which is provided with a roller making contact with the inverter guide and receiving and retarding a sheet fed over the guide. By such a device the movement of the sheet is controlled to some extent, but with the disadvantage that if the sheet has already skewed at the moment of being engaged by the roller, the sheet will maintain and hence be delivered in the oblique position.

The object of the present invention is to provide a sheet inverter by which the direction of movement of sheets advancing even at high speed can be reversed with avoidance of the above-noted disadvantages of known devices.

In a sheet inverter according to the present invention, a guide member is provided which has a sheet guiding surface leading to an end edge portion thereof that is spaced away from means for feeding a sheet onto the guide member so that the leading edge of the sheet will be passed over the end edge portion; and at a small distance from the end edge portion an edge deflecting surface of a bend-over guide is provided which lies across and at an acute angle to the path of the leading edge so that the edge will engage against and be slid along the deflecting surface, thus bending a leading portion of the sheet about the end edge portion of the guide member. The advance movement of the sheet is effectively retarded in this way, and the sheet is positioned for delivery in the reverse direction by backward movement over and away from the guide member.

During the movement of the leading edge of the sheet along the deflecting surface a progressive bending of a leading portion of the sheet takes place, causing this portion to be resiliently constrained with gradually increasing force and thus effectively retarded. Uncontrollable sheet rebounding is thus obviated. Moreover, if the sheet reaches the guide member in an oblique position, the leading portion of the sheet will become bent and retarded while the rest of the sheet moves on without retardation; so the sheet will pivot about the leading point in a direction to correct the oblique position.

The type of sheets to be processed and the speed of sheet advance onto the guide member determine the extent to which a sheet should be bent and retarded and hence the distance from the guide member and the angle at which the edge deflecting surface of the bend-over guide should be disposed for optimum results. It has been found that for the practical situation often occurring, in which sheets of paper of A-4 size and weighing 60–120 g/m$^2$ are to be processed while being advanced at a speed of 40–60 cm/sec, a very reliably operating embodiment of the invention is obtained when the edge deflecting surface lies at a distance of between 3 and 10 mm from and at an angle of between 60° and 85° to the end edge portion of the guide member.

Although the sheet guiding surface of the guide member may be flat or of some other form, according to a further feature of the invention the guiding surface is bowed concavely in order to bend a sheet fed thereonto in a direction opposite to the direction of the bend formed in the leading edge portion of the sheet by the movement of its edge along the deflecting surface of the bend-over guide. In this way an advantage is achieved in that, at the start of the reverse movement for delivery of the sheet, the sheet can straighten out so that the angle between its bend-over leading edge portion and the body of the sheet is reduced. This reduces the constraining force on the leading edge portion of the sheet and thus facilitates delivery of the sheet from the guide member.

It may also be advantageous to form a bowed sheet guiding surface of the guide member with one or more angled recesses, or valleyed regions, extending across the direction of the sheet movement. This enables a sheet to be bowed more or less deeply into the recesses, so the inverter can deliver in the correct position sheets that have different dimensions in the direction of sheet movement.

The invention will be further understood from the following description in which reference is made to the accompanying drawing.

The drawing shows schematically in side elevation a sheet inverter provided according to a preferred embodiment of the invention.

As shown in the drawing, three rotatable rollers 1, 2 and 3 which run in contact with one another are arranged at the lower end of a sheet inverter that comprises a guide member 4 bent angularly to a bowed shape preferred for its inner sheet guiding surface.

The guide member 4 is composed of three straight guiding segments 5, 6 and 7 which merge with one another at angles of, for example, about 120°. The farthest segment 7 leads to an end edge portion 7*a* of the guide member, from which a backwardly projecting connecting leg 8 extends so as to support a forwardly protruding bend-over guide 9. The bend-over guide presents an edge deflecting surface 9*a* lying across and at an acute angle to the path of a sheet edge advanced over the end edge portion 7*a*. The surface 9*a* is disposed, for example, at a distance of about 7 mm from the end edge of the guide member 4 and so as to include an angle of about 75° with the surface of the guiding segment 7.

The rollers 1 and 2 feed a sheet onto the guide member 4 so that the leading edge of the sheet is pushed up as it is fed along the guiding surface. During this advance movement, the sheet is resiliently bowed in discrete zones by being pressed against the guide segments 5, 6 and 7 in succession. When the sheet has been advanced so far that its leading edge passes over the end edge portion *7a* of segment 7, the leading edge comes into contact with the deflecting surface 9*a* and then advances further along that surface, thus deflecting a leading portion of the sheet so that it is bent around the edge portion *7a* of the guide member. During this movement, as a result of the resiliency of the sheet, the sheet will be constrained and hence retarded with progressively increasing force between the bend-over guide 9 and the end edge portion of guide member 4 between segment 7 and leg 8.

If the sheet is fed in an oblique position by the rollers 1 and 2, the leading point of the sheet will first reach the bend-over guide 9 and thus be retarded while the rest of the sheet can move on uninhibited. A torque is thus exerted on the sheet by which the oblique position is corrected. Consequently, irrespective of whether the sheet is fed to the inverter in the correct position or in an oblique position, upon leaving the nip between the rollers 1 and 2 the sheet will occupy the position indicated by line a in the drawing, in which position the trailing edge of the sheet over its entire length is pressed against the roller 2 as a result of the tension in the sheet. A sheet longer than that illustrated in the drawing will in this position take a posture in which it lies closer to the guide member at the angled recesses between the segments 5, 6 and 7.

The continuing rotation of roller 2 then causes the trailing edge of the sheet to be entrained by the surface of roller 2, as a result of which the trailing edge is turned downward and disposed in the nip between rollers 2 and 3 so as to be engaged by those rollers for delivery of the sheet in the reverse direction. This position of the sheet is indicated by line b in the drawing.

From the moment when the sheet is first conveyed by rollers 2 and 3, the sheet will stretch out gradually and be brought into the position indicated by line c in the drawing. In this position the buckling of the sheets is substantially eliminated, thus reducing the bend-over angle of the originally leading portion of the sheet so that the sheet no longer is constrained in a way that might impede its delivery.

I claim:

1. A sheet inverter comprising a guide member presenting a sheet guiding surface leading to an end edge portion thereof; means for feeding a sheet forward onto and then along and over said surface so that the leading edge of the sheet will be passed in a substantially straight path over said end edge portion; and means for retarding forward movement of the sheet comprising a guide means presenting a leading edge deflecting surface disposed across and at an acute angle to said path of said leading edge and spaced a small distance away from said end edge portion so that a leading edge portion of the sheet fed over said guiding surface will be bent about said end edge portion and constrained between it and said edge deflecting surface, thereby positioning the sheet for delivery from the guide member by backward movement.

2. A sheet inverter according to claim 1, said edge deflecting surface being disposed at a distance of 3 to 10 mm from said end edge portion and at an angle of 60° to 85° to said path.

3. A sheet inverter according to claim 1, said sheet guiding surface being bowed concavely so that a sheet fed thereonto is bent in a direction opposite to the direction of the bend of its leading edge portion about said end edge portion.

4. A sheet inverter according to claim 3, said sheet guiding surface being formed with at least one region recessed from and extending transverse to said path of forward movement of the sheet over said guide member.

5. A sheet inverter according to claim 4, said edge deflecting surface being disposed at a distance of 3 to 10 mm from said end edge portion and at an angle of 60° to 85° to said path.

6. A sheet inverter according to claim 1, said sheet guiding surface being composed of three substantially straight surface segments merging each with another at an angle of the order of about 120°.

7. A sheet inverter according to claim 2, said sheet guiding surface being composed of three substantially straight surface segments merging each with another at an angle of the order of about 120°.

8. A sheet inverter comprising a guide member presenting a stationary sheet guiding surface leading to an end edge portion thereof; means for feeding a sheet forward onto and then along and over said surface so that the leading edge of the sheet will be passed in a substantially straight path over said end edge portion; and means for retarding forward movement of the sheet comprising guide means presenting a leading edge deflecting surface disposed across and at an acute angle to said path of said leading edge and spaced a small distance away from said end edge portion so that a leading edge portion of the sheet fed over said guiding surface will be bent about said end edge portion and constrained between it and said edge deflecting surface, thereby positioning the sheet for delivery from the guide member by backward movement;

said guiding surface being bowed concavely so that the body of a sheet fed thereonto is bent in a direction opposite to the direction of the bend of its leading edge portion about said end edge portion, said guiding surface being formed with at least one valleyed region extending transverse to said path to accommodate sheets having different dimensions in the direction of the sheet movement.

9. A sheet inverter according to claim 8, said guiding surface being composed of three substantially straight stationary surface segments merging each with another at an angle of the order of about 120°.

10. A sheet inverter according to claim 8, said edge deflecting surface being disposed at a distance of 3 to 10 mm from said end edge portion and at an angle of 60° to 85° to said path.

11. A sheet inverter according to claim 9, said edge deflecting surface being disposed at a distance of 3 to 10 mm from said end edge portion and at an angle of 60° to 85° to said path.

* * * * *